US008572954B2

(12) United States Patent
DeYoung et al.

(10) Patent No.: US 8,572,954 B2
(45) Date of Patent: Nov. 5, 2013

(54) WORK MACHINE WITH EASILY SERVICEABLE EXHAUST AFTERTREATMENT DEVICE

(75) Inventors: James T. DeYoung, Dubuque, IA (US); Jeremy M. Kreutner, Peosta, IA (US); Christopher M. Ruden, Peosta, IA (US); Satish Parthasarathy, Maharashtra (IN); Michael J. Ackerman, Peosta, IA (US); Dustin T. Staade, Dubuque, IA (US); Joseph B. Fochs, Dubuque, IA (US); Daniel J. Wild, Dubuque, IA (US)

(73) Assignee: Deere & Company, Moline, IL (US)

( * ) Notice: Subject to any disclaimer, the term of this patent is extended or adjusted under 35 U.S.C. 154(b) by 327 days.

(21) Appl. No.: 13/044,944

(22) Filed: Mar. 10, 2011

(65) Prior Publication Data

US 2012/0227376 A1 Sep. 13, 2012

(51) Int. Cl.
*F01N 1/00* (2006.01)
*F01N 3/02* (2006.01)

(52) U.S. Cl.
USPC ..... 60/322; 60/311

(58) Field of Classification Search
USPC ..... 60/297, 299, 301, 311, 322
See application file for complete search history.

(56) References Cited

U.S. PATENT DOCUMENTS

2010/0031644 A1* 2/2010 Keane et al. ..... 60/295
2010/0326219 A1* 12/2010 Nelson et al. ..... 73/865.8
2011/0180344 A1* 7/2011 Kimura ..... 180/309

FOREIGN PATENT DOCUMENTS

WO WO 2010047199 A1 * 4/2010

* cited by examiner

*Primary Examiner* — Kenneth Bomberg
*Assistant Examiner* — Audrey K Bradley
(74) *Attorney, Agent, or Firm* — Quarles & Brady LLP

(57) ABSTRACT

A work machine powered by an internal combustion engine having an exhaust aftertreatment device and air cleaner positioned over the top portion of the engine, which is mounted in the work machine chassis. A frame is releasably connected to the chassis through an adjustable mounting with three axis adjustment and the air cleaner is mounted to the frame. A carriage is releasably mounted to the frame and carries the exhaust aftertreatment device to enable independent removal for servicing and/or replacement.

18 Claims, 5 Drawing Sheets

WORK MACHINE WITH EASILY SERVICEABLE EXHAUST AFTERTREATMENT DEVICE

FIELD OF THE INVENTION

The present invention relates to work machines, and, more particularly, to such machines with exhaust aftertreatment devices.

BACKGROUND OF THE INVENTION

Although EPA laws have required manufacturers of highway vehicles to utilize exhaust aftertreatment devices to meet emissions requirements for a number of years, further EPA regulations require the use of exhaust aftertreatment devices in off-road vehicles generally described as work machines. The work machines may take many forms including end loaders, back hoes, combines, and other agricultural equipment.

The application of exhaust aftertreatment devices, which can be bulky, to the work machine, requires implementation quite different than the application for highway vehicles. Generally speaking, there is adequate room in a highway vehicle to support the bulky exhaust aftertreatment device away from or underneath the engine.

For work machines, there is a need for a compact engine envelope since the work machine must accomplish many more tasks beyond motion along the ground. This requires a significantly greater utilization of devices that perform power functions in addition to the forward velocity of the machine. As such, the engine components for a work machine are positioned on top of the engine. Turbochargers, exhaust devices, and intake filters are usually positioned over the top of the engine. While this provides a compact engine envelope, it presents additional problems in the servicing of the engine and its components.

Particularly, the exhaust aftertreatment device must be removed after a given period of operating hours for replacement and may also be required to be removed for servicing during that interval. In addition, engine components along the top of the engine are periodically required to be serviced. With the substantial bulk of the exhaust aftertreatment device and intake air filter on the top of the engine, servicing the exhaust aftertreatment device and/or the top engine components is a problem.

What is needed in the art, therefore, is an arrangement for ready and easy servicing of the exhaust aftertreatment device and/or the top portion of the engine.

SUMMARY

In one form, the invention is a power system including an air-breathing, fuel-consuming internal combustion engine (IC) engine providing a rotary output and producing products of combustion through an exhaust pipe. A frame is positioned adjacent to and over the top portion of the IC engine. An exhaust aftertreatment device is releasably connectable to the exhaust pipe, the exhaust aftertreatment device being positioned over the top portion of the IC engine. A carriage supports the exhaust aftertreatment device and the carriage is releasably connected to the frame for independent removal of the exhaust aftertreatment device so that it may be easily serviced and replaced.

In another form, the invention is a work machine including a chassis and an air-breathing, fuel-consuming internal combustion (IC) engine providing a rotary output for the chassis and producing products of combustion through an exhaust pipe. A frame is supported by the chassis and positioned adjacent to and over the top portion of the IC engine. An exhaust aftertreatment device is releasably connectable to the exhaust pipe, the exhaust aftertreatment device being positioned over the top portion of the IC engine. A carriage supports the exhaust aftertreatment device with the carriage being releasably connected to the frame for independent removal of the exhaust aftertreatment device so that it may be easily serviced and replaced.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one embodiment of the invention and such exemplifications are not to be construed as limiting the scope of the invention in any manner.

DETAILED DESCRIPTION

Figure 1:
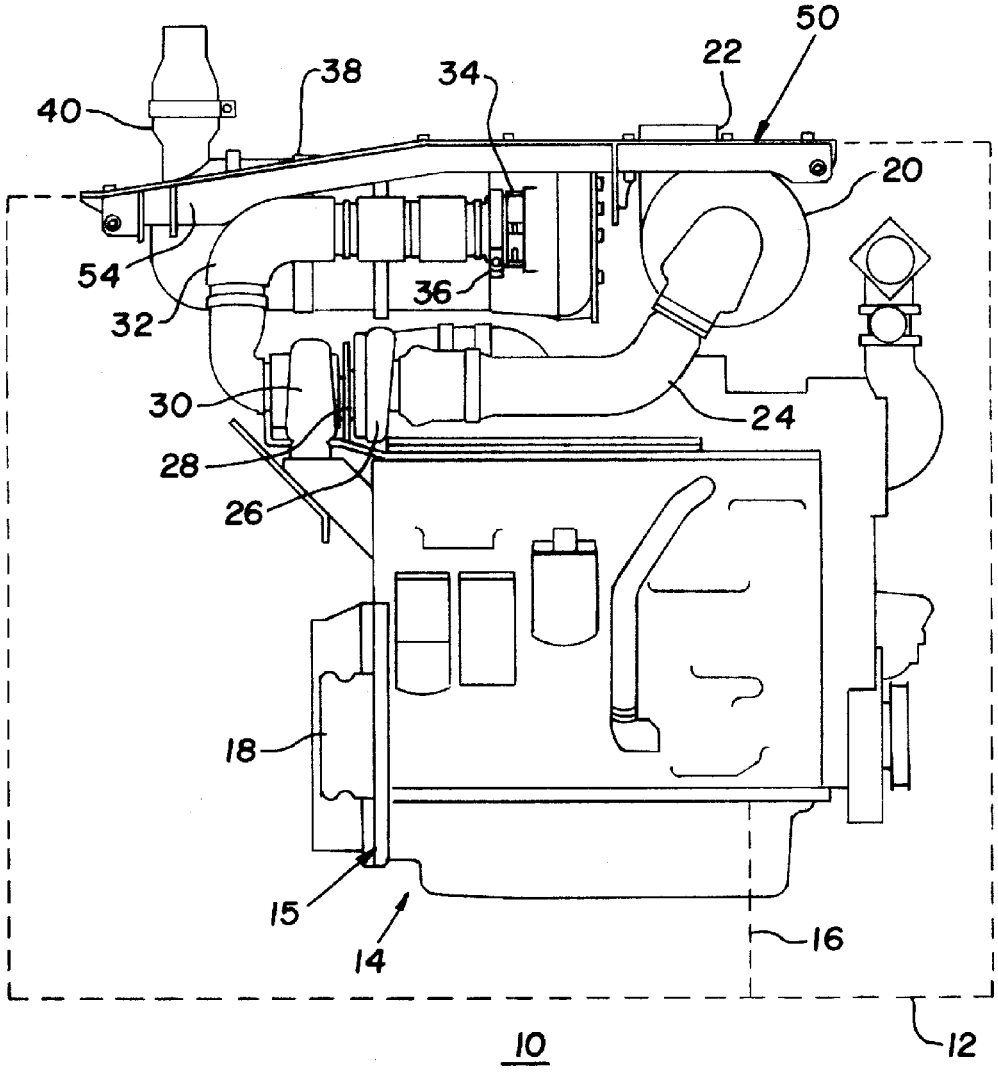
FIG. 1 shows a side view of a work machine embodying the present invention.

Referring now to the drawings, and more particularly to FIG. 1 shows a work machine 10 in diagrammatic fashion. Work machine 10 may be one of a number of types of non-highway machines including backhoes, combines, and the like. Work machine 10 has a chassis 12, which provides the structural support for ground movement wheels, steering, and work machine components, most of which are powered by a power system generally designated at 14. Power system 14 includes an internal combustion (IC) engine 15 of the air-breathing, fuel-consuming type producing products of combustion. Engine 15, as herein shown, is of the compression ignition, or diesel, type in which intake air is highly compressed and fuel injected in appropriate amounts and at the proper time into cylinders having reciprocating pistons to produce combustion. The combustion event causes the pistons to reciprocate and, through a crankshaft (not shown), produce a rotary output at flywheel 18. The engine 15 is structurally supported in chassis 12 by appropriate structure indicated schematically in FIG. 1. by 16 and by a structural support 16 in FIGS. 2-4. Combustion air for engine 15 passes through an intake air filter 20 from an air filter inlet 22 which is vertically oriented. The air from air filter 20 passes through a flexible conduit 24 to the inlet of a compressor 26 of a turbocharger 28. The air thus pressurized by compressor 26 passes to the engine for pressurization and subsequent combustion to produce a rotary power output from engine 15.

The products of combustion then pass to a turbine 30, which drives the compressor by virtue of the hot gasses passing over it. The exhaust from turbine 30 passes through an exhaust pipe 32 having various sections making up a flow passage and connecting with the inlet 34 of an exhaust aftertreatment device 38 at a flange mated by a releasable clamp 36. Exhaust aftertreatment device 38 serves multiple functions, for example, diesel particulate filtration and oxides of nitrogen reduction. The gasses thus processed are discharged through an upwardly directed outlet 40. In typical fashion, there is an engine compartment cover that mates with the inlet 22 and outlet 40 for weather protection and servicing when the cover is removed.

As noted above, the power system 14 is required to be in a compact overall configuration. As such, the intake air filter 20 and exhaust aftertreatment device 38 are required to be mounted over the top of the engine 15. While this arrangement facilitates compactness, it creates problems with respect to servicing of the exhaust aftertreatment device 38 and access to the top portion of the engine 15, for example, to service injectors or to adjust valve lash.

In accordance with the present invention, the structure shown in FIGS. 1-5 is employed to allow efficient and simplified servicing of the exhaust aftertreatment device or service the top portion of engine 15. A frame 50 provides a structural support for the filter 20 and through a carriage 52 to the exhaust aftertreatment device 38. Frame 50 includes longitudinal frame members 54 and 56, each of which has an L-shaped cross-sectional configuration. Frame members 54 and 56 are positioned adjacent and over the top portion of engine 15 and extend in a longitudinal direction relative to the axis of the flywheel 18. A cross plate 58 provides support for the air filter 20 so that the air filter 20 is substantially below the frame 50.

Figure 2:
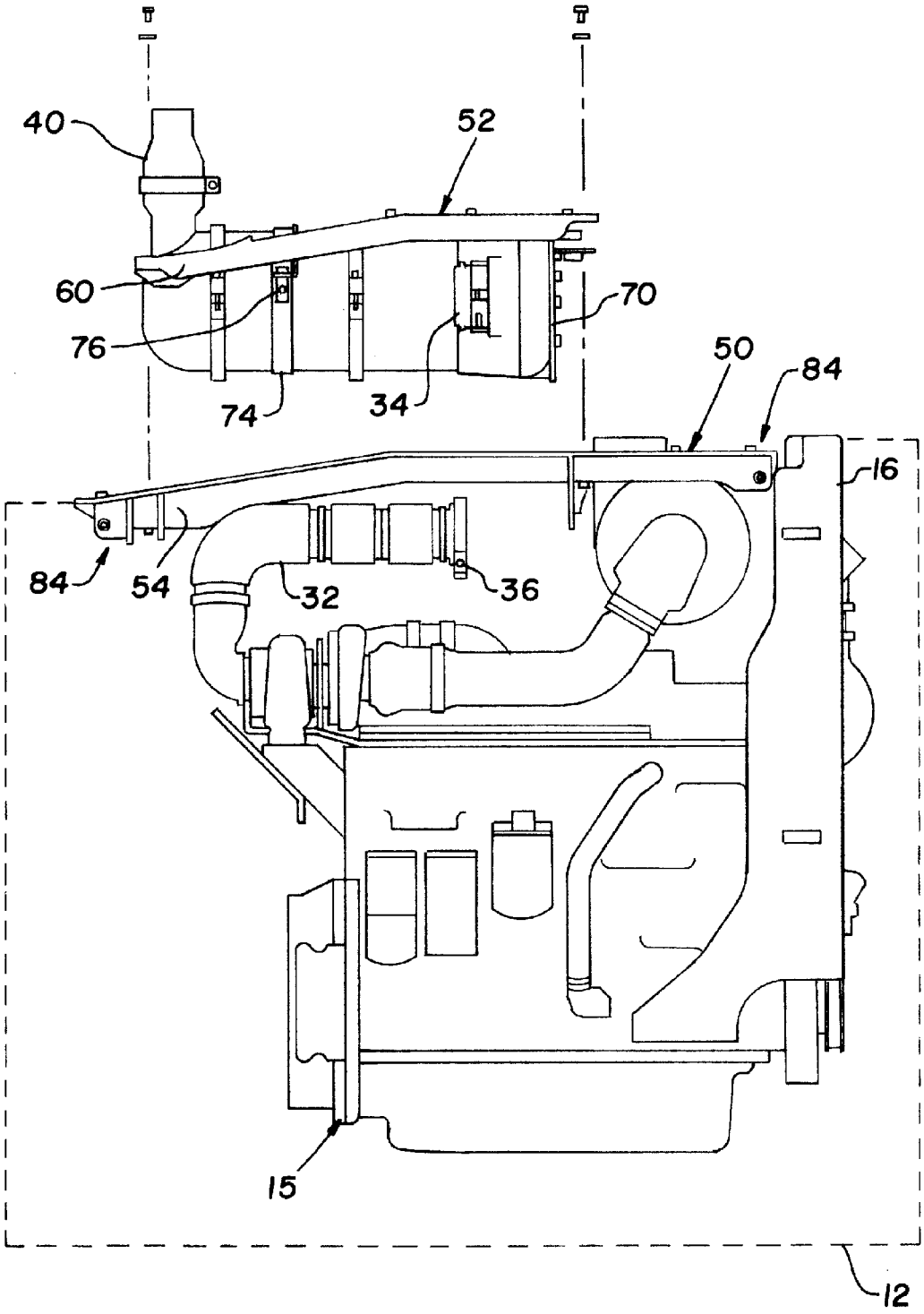
FIG. 2 is a side view of the work machine of FIG. 1 with an exhaust aftertreatment device removed.
Figure 3:
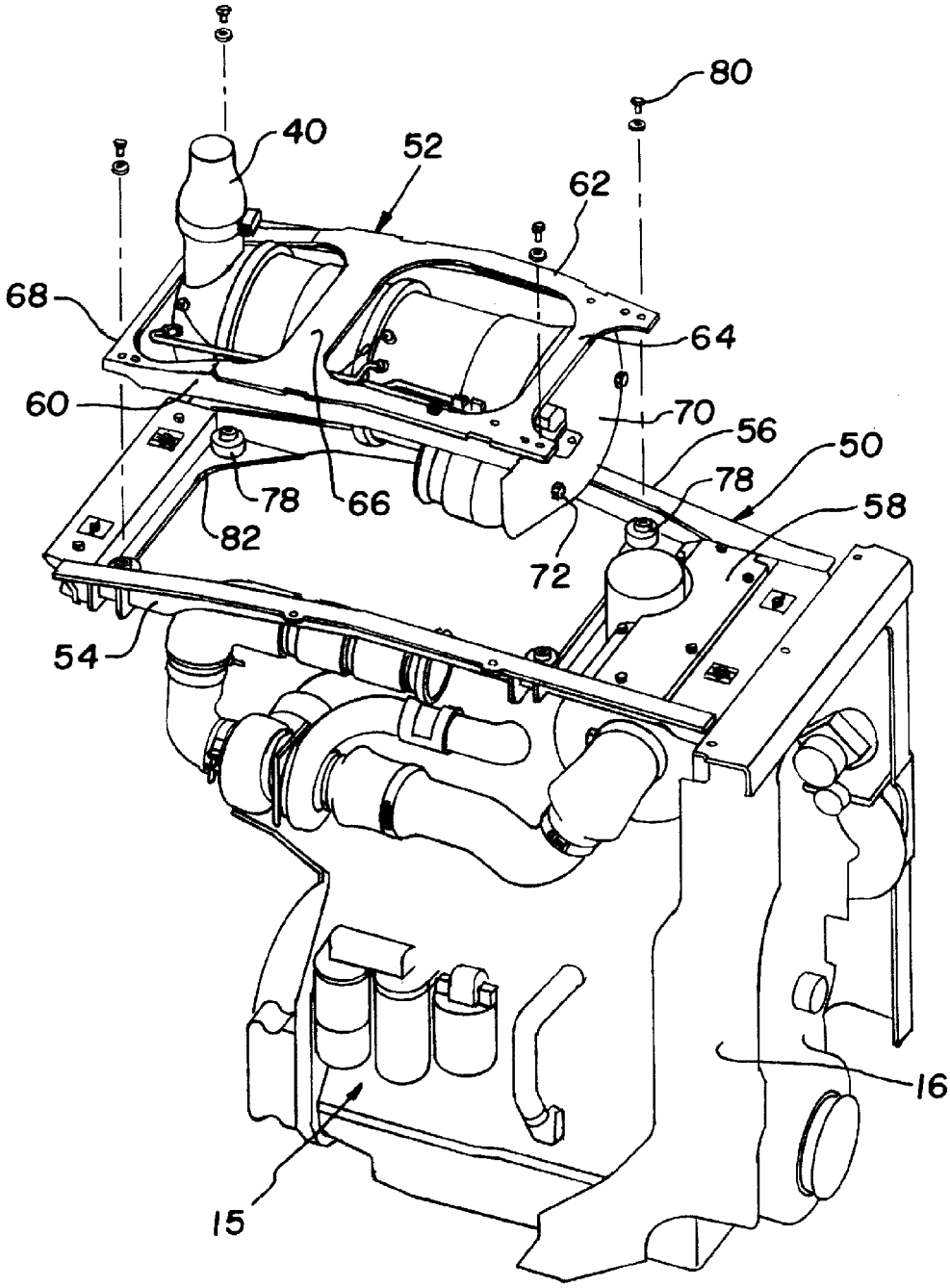
FIG. 3 is a perspective view of the work machine shown in FIG. 2.
Figure 4:
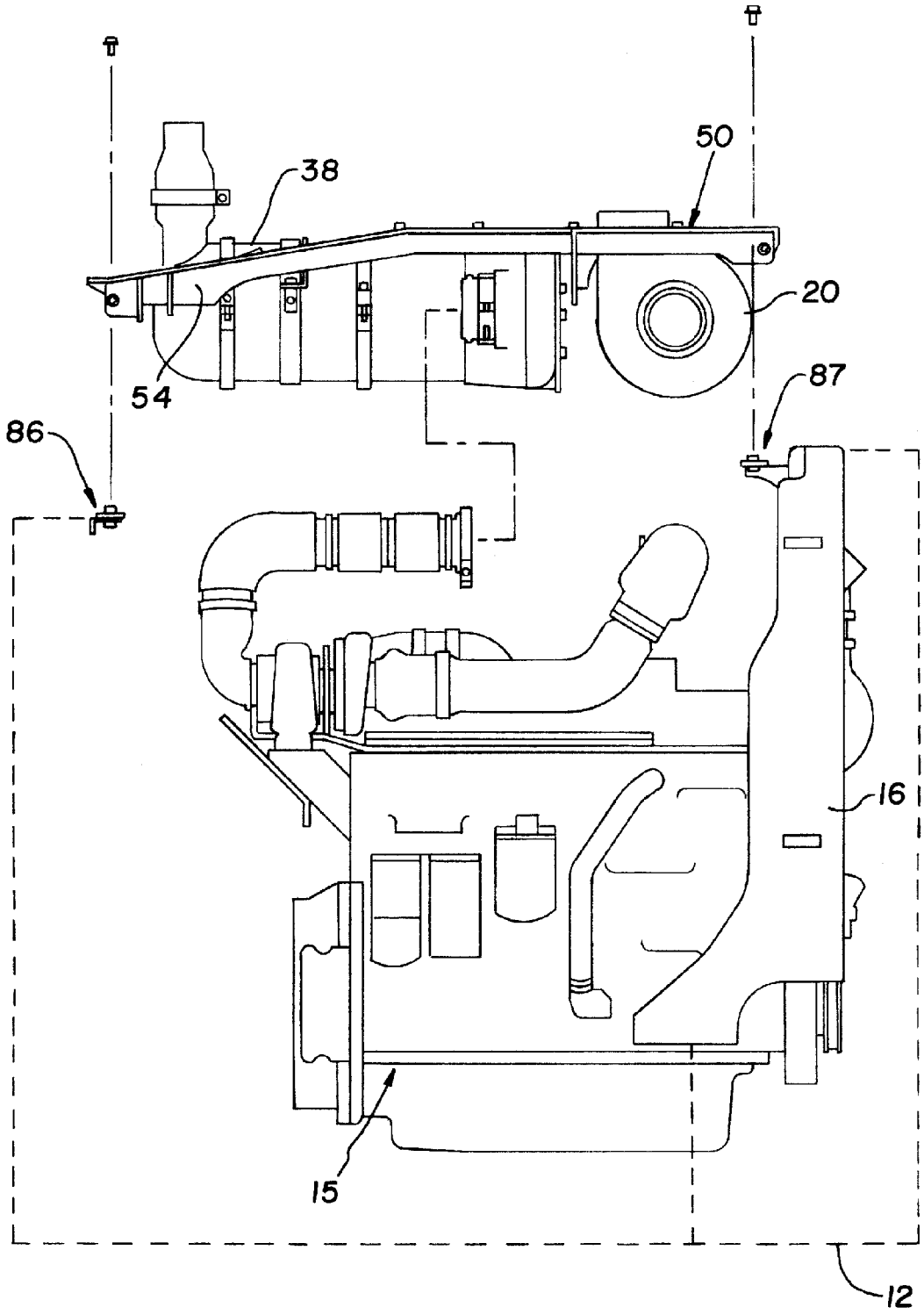
FIG. 4 is a side view of the work machine of FIG. 1 showing a different method of disassembly.

The exhaust aftertreatment device 38 has a primary structural interconnection with carriage 52 as particularly shown in FIGS. 2 and 3. Carriage 52 has side members 60 and 62 with integral cross members 64, 66, and 68. Integral with cross member 64 is an end plate 70 to which one end of the exhaust aftertreatment device 38 is attached through fastening screws 72. The midsection of exhaust aftertreatment device 38 is supported to the side members 60 and 62 by a strap 74 and screw 76. The carriage 52, as shown particularly in FIGS. 2 and 3, is supported by frame 50 through vibration isolators 78 at the four corners of carriage 52 and held in place by screws 80. The vibration isolators 78 are, in turn, supported on web structures 82 interconnected with longitudinal frame members 54 and 56 of the frame 50.

In the positions illustrated in FIG. 1, the exhaust aftertreatment device 38 is supported by carriage 52, which is, in turn, supported by frame 50. Frame 50 is secured to chassis 12 by adjustable mountings 84, which will be described in detail later.

The exhaust aftertreatment device 38 requires periodic servicing and, after a given period of time, requires replacement. In addition, the exhaust aftertreatment device 38 weighs well over 100 pounds and is not easily removed by a single mechanic. For servicing of the exhaust aftertreatment device, the clamp 34 is removed, thus freeing the inlet 36 of exhaust aftertreatment device from exhaust pipe 32. Additional sensor and control lines between the exhaust aftertreatment device 38 and the engine 15 are disconnected. At that point, lifting lugs (not shown) are connected to carriage 52, enabling the carriage 52 to be removed from the engine by a hoist in a vertical direction. As such, the exhaust aftertreatment device may be serviced and/or replaced with a minimum disturbance of the remaining engine components. The position shown in FIGS. 2 and 3 illustrate the condition in which the exhaust aftertreatment device 38 has been removed.

Under other circumstances, the top of the engine must be exposed for various operations including, for example, valve adjustment and injector servicing. For this purpose, the entire frame 50 (with carriage 52 and exhaust aftertreatment device 38) is removed from the associated chassis mountings indicated as plate 86 connected to a hydraulic oil reservoir (not shown) on one end and a plate 87 connected to the engine mounting frame 16 at the opposite end. In this circumstance, both the exhaust aftertreatment device 38 and the filter 20 are removed as a unit. For this purpose, lifting lugs (not shown) may be fastened to carriage 52 so that the entire unit may be hoisted from the unit as shown particularly in FIG. 4. With the additional weight of the air filter added to that of the exhaust aftertreatment device 38, a hoist becomes even more necessary. When the frame 50, including the exhaust aftertreatment device 38 and filter 20, is removed, there is free access to the top portion of the engine for various service and repair functions.

The alignment of the exhaust pipe 32 and inlet 34 for the exhaust aftertreatment device is critical and it is necessary to ensure that when the frame 50 is removed, it may be installed in the same three axis position in which it was manufactured. For this purpose, the adjustable mountings 84 are employed.

Figure 5:
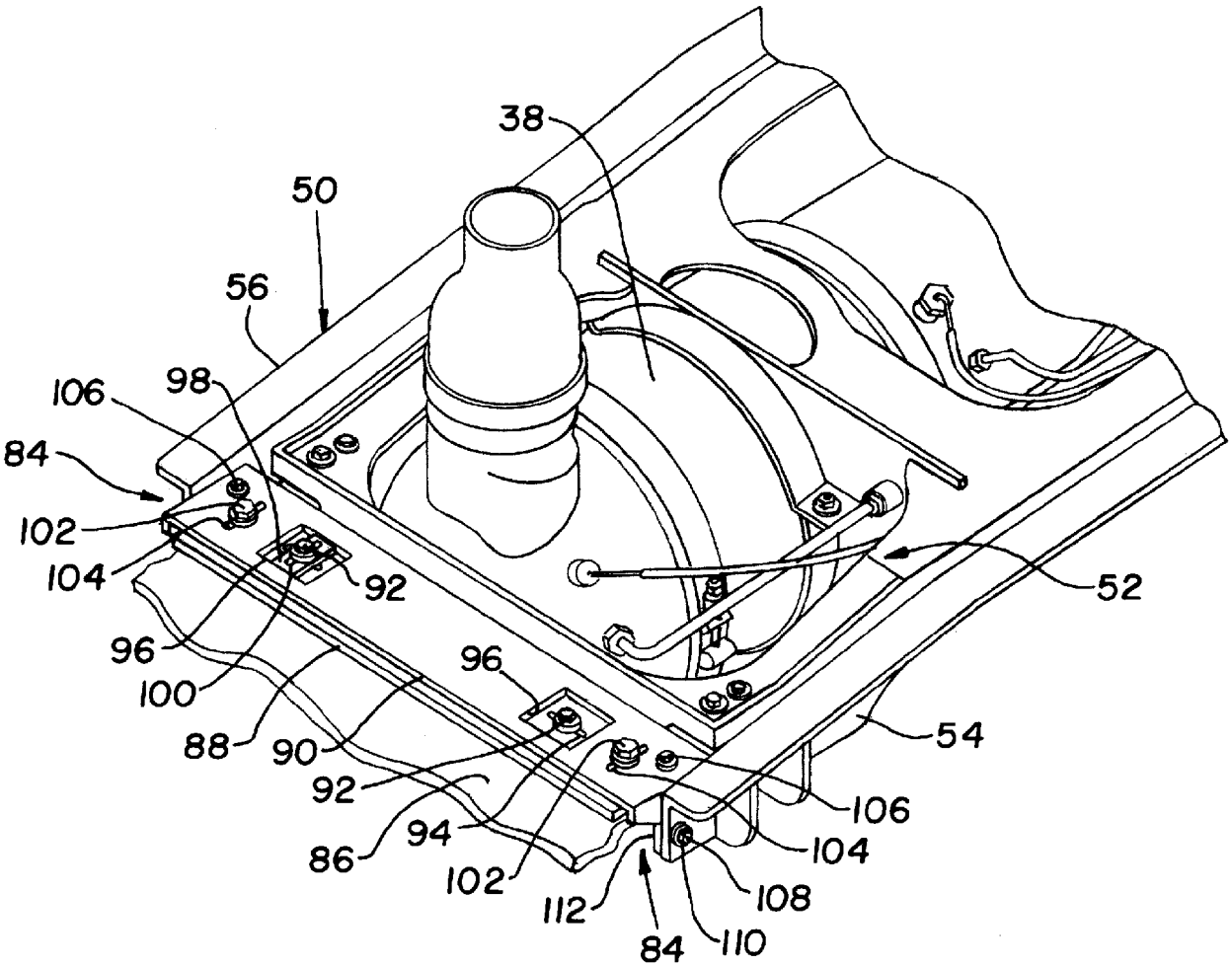
FIG. 5 shows expanded details of an adjustable releasable joint incorporated in the work machine of FIG. 1.

Referring to FIG. 5, the details of the adjustable mountings 84 are shown. For purposes of simplifying the discussion of the present invention, only the pair of adjustable mountings 84 at one end of frame 50 will be shown. The adjustable mountings 84 at the opposite end are identical in function. The connection includes the plate 86, which is fixed to the chassis 12 and receives an intermediate cross plate 88. A cross plate 90 for frame 50 extends between longitudinal frame members 54 and 56 and, in effects, sandwiches intermediate plate 88 when the frame 50 is in position.

As stated previously, the adjustable mountings 84 permit side-to-side, fore and aft, and vertical adjustment so that when the frame 50 is removed, it can be placed in the same position set at the factory. The side-to-side adjustment is accomplished by bolts 92 extending through transverse slots 94 in intermediate cross plate 88 and received in plate 86. Openings 96 in frame cross plate 90 permit the adjustment of intermediate cross plate 88 from side-to-side and through the structural connection with carriage 52, the side-to-side position of exhaust aftertreatment device 38 and, more specifically, its inlet 34. During this procedure, the bolts 92 are loose to permit the sideways movement of frame cross plate 90 and intermediate cross plate 88. When this is set, the right most bolt 92 is fastened but the left bolt 92, as viewed in FIG. 5, is still loose for permitting the fore and aft movement. A lock plate 98 is received in the left most opening 96 and has a longitudinal slot 100 permitting longitudinal or fore and aft movement. It should be noted that the length of plate 98 is such that it abuts the fore and aft edges of opening 96. A second pair of bolts 102 extends through longitudinal slots 104 in frame cross plate 90 and are received in intermediate cross plate 88. At this point, the fore and aft adjustment of frame cross plate 90 and, thus, the exhaust aftertreatment device 38 is set. The left bolt 92 is, at this point, loose to permit fore and aft movement. Once the fore and aft position is fixed, the bolts 102 are tightened and the left bolt 92 tightened to hold the lock plate 98 in position.

The vertical adjustment of frame 50 relative to the chassis is accomplished by bolts 106 extending through frame cross plate 90 and are received in threaded connections (not shown) on the longitudinal frame members 54 and 56. The bolts 106 are turned to adjust the vertical height of the longitudinal frame members 54 and 56 and, thus, the vertical height of exhaust aftertreatment device 38. The weight of the longitudinal frame members 54 and 56 hold the bolts 106 in place. The vertical adjustment is fixed by bolts 108 that extend through slots 110 in longitudinal frame members 54 and 56 and are threaded into a downward directed flange 112 on frame cross plate 90. The bolts 108 are tightened to fix the vertical position of frame 50 and, thus, the vertical position of exhaust aftertreatment device 38.

The side-to-side and fore and aft adjustments may be made sequentially or, in a factory setting, simultaneously along with the vertical adjustment through bolts 106. Once the adjustments are made, the various bolts 92, 102, and 108 are tightened to secure the frame in place in the proper position. The removal of the frame 50 is accomplished by loosening bolts 102 to remove both the exhaust aftertreatment device 38 and the filter 20. When the frame 50 is again put in place, the lock plate 98 sets the fore and aft position because its length abuts the fore and aft edges of opening 96 while the side-to-side position is set by lining up the slots 104 so that bolts 102 can be fastened.

As a result, the exhaust aftertreatment device 38 may be removed independent of the frame 50 because of the separate carriage 52. Since its vibration isolators 78 are fixed, the exhaust aftertreatment device 39 may be installed in the same relative position. When the entire frame 50 is removed, the lock plates 98 and slot arrangements ensure that the frame 50 is reinstalled in the same position as set by the factory. The result is very efficient and effective servicing of the exhaust aftertreatment device 38 and the ability to service the top portion of engine 15 without compromising the factory set position of the exhaust aftertreatment device relative to its mating component on engine 15.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

The invention claimed is:

1. A power system comprising:

an air-breathing, fuel-consuming internal combustion (IC) engine providing a rotary output and producing products of combustion through an exhaust pipe;

a frame positioned adjacent to and over a top portion of said IC engine;

an exhaust aftertreatment device connectable to said exhaust pipe and positioned over the top portion of said IC engine;

a carriage connected to said frame and supporting said exhaust aftertreatment device; and an air cleaner supported by said frame and being positioned at least in part beneath said frame.

2. The power system of claim 1, wherein said frame is removable vertically.

3. The power system of claim 1, wherein the exhaust aftertreatment device and the air cleaner have cylindrical outer configurations and wherein the exhaust aftertreatment device and the air cleaner are at right angles to one another.

4. The power system of claim 1, wherein the air cleaner is supported directly by said frame.

5. The power system of claim 4, wherein said frame is releasably positioned adjacent the top portion of said IC engine to remove the exhaust aftertreatment device and air cleaner to expose the top portion of said engine.

6. The power system of claim 1, wherein said carriage and exhaust aftertreatment device are removable vertically.

7. The power system of claim 6, wherein said exhaust aftertreatment device is at least in part positioned beneath said frame.

8. The power system of claim 7, further comprising vibration isolators between said carriage and said exhaust aftertreatment device.

9. A work machine comprising:

a chassis;

an air-breathing, fuel-consuming internal combustion (IC) engine providing a rotary output for said chassis and producing products of combustion through an exhaust pipe, said engine being supported in said chassis;

a frame supported by said chassis and positioned adjacent to and over a top portion of said IC engine;

an exhaust aftertreatment device connectable to said exhaust pipe and positioned over the top portion of said IC engine;

a carriage connected to said frame and supporting said exhaust aftertreatment device; and an adjustable mounting between said frame and said chassis, wherein said adjustable mounting comprises a horizontal plate fixed to said chassis and an intermediate plate overlying said fixed plate and adjustably connected to said first plate in a fore and aft and side-to-side adjustment relative to said engine, a frame cross plate of said frame being connectable to said intermediate plate.

10. The work machine of claim 9, wherein said frame cross plate has an opening and said work machine further comprises a lock plate adjustably positioned on said intermediate plate and received in said opening to set the fore and aft position of said frame.

11. The work machine of claim 10, wherein said frame cross plate is vertically adjustable relative to said frame to provide the three axis adjustment.

12. The work machine of claim 10, wherein said frame cross plate is threadedly adjustable relative to said frame for said vertical position.

13. The work machine of claim 9, wherein said carriage is removable vertically.

14. The work machine of claim 13, wherein the exhaust aftertreatment device is positioned at least in part beneath said frame.

15. The work machine of claim 14, wherein the exhaust aftertreatment device is mounted through vibration isolation.

16. The work machine of claim 9, further comprising an air cleaner mounted to said frame.

17. The work machine of claim 16, wherein disconnecting said frame from said chassis removes the exhaust aftertreatment device and said air filter for exposing the top portion of the IC engine.

18. The work machine of claim 17, wherein the adjustable mounting between said frame and said chassis provides three axis adjustment of the exhaust aftertreatment device.

* * * * *